US011168883B2

(12) United States Patent
Benning et al.

(10) Patent No.: US 11,168,883 B2
(45) Date of Patent: Nov. 9, 2021

(54) FLAME ARRESTOR WITH FLUID DRAINAGE CAPABILITIES

(71) Applicant: Rosemount Aerospace Inc., Burnsville, MN (US)

(72) Inventors: Kevin Benning, Lakeville, MN (US); Aaron Wesser, Apple Valley, MN (US); Scott Wigen, Eagan, MN (US); Andrew Sherman, Farmington, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 323 days.

(21) Appl. No.: 15/720,834

(22) Filed: Sep. 29, 2017

(65) Prior Publication Data

US 2019/0101284 A1 Apr. 4, 2019

(51) Int. Cl.

| | |
|---|---|
| ***F23D 14/72*** | (2006.01) |
| ***A62C 4/00*** | (2006.01) |
| ***F23D 14/74*** | (2006.01) |
| ***F23D 14/82*** | (2006.01) |

(52) U.S. Cl.

CPC ..... *F23D 14/725* (2013.01); *A62C 4/00* (2013.01); *F23D 14/74* (2013.01); *F23D 14/82* (2013.01); *F05D 2260/602* (2013.01)

(58) Field of Classification Search

CPC ..... A62C 4/00; F23D 14/82; F23D 14/84

USPC ..... 60/39.11; 220/88.2

See application file for complete search history.

(56) References Cited

U.S. PATENT DOCUMENTS

| | | | | |
|---|---|---|---|---|
| 258,749 | A * | 5/1882 | Hall | A62C 4/00 220/88.2 |
| 3,394,844 | A * | 7/1968 | Pringle | F16K 24/04 220/88.2 |
| 4,317,868 | A * | 3/1982 | Spiegelberg | H01M 2/1205 429/82 |
| 4,870,855 | A | 10/1989 | Shafer | |
| 5,902,161 | A | 5/1999 | Nakase | |
| 9,908,679 | B2 * | 3/2018 | Limbacher | B65D 81/022 |
| 2009/0162745 | A1 | 6/2009 | Iwamoto et al. | |
| 2010/0181190 | A1 | 7/2010 | Romaniuk | |
| 2011/0008739 | A1 * | 1/2011 | Mungas | F16K 17/40 431/346 |

(Continued)

FOREIGN PATENT DOCUMENTS

| | | | |
|---|---|---|---|
| AU | 197130517 | A | 6/1971 |
| AU | 198170185 | A | 12/1981 |

(Continued)

OTHER PUBLICATIONS

"Machine Translation of DE 102014007414". 2019.*

(Continued)

*Primary Examiner* — Jason Lau

(74) *Attorney, Agent, or Firm* — Kinney & Lange, P.A.

(57) ABSTRACT

A vented module includes a housing portion having a drainage side and a drainage port within the drainage side. The module further includes a flame arrestor including a first surface having a fluid inlet, a second surface having at least one fluid outlet, a labyrinth channel extending from the fluid inlet to the fluid outlet, and at least one mesh screen disposed within the labyrinth channel. The flame arrestor is attached to the housing portion such that the drainage port is aligned with the fluid inlet.

14 Claims, 5 Drawing Sheets

(56) References Cited

U.S. PATENT DOCUMENTS

| | | | | |
|---|---|---|---|---|
| 2011/0146231 | A1* | 6/2011 | Mungas | F23D 14/82 60/243 |
| 2013/0206759 | A1* | 8/2013 | Wurz | A62C 3/00 220/88.2 |
| 2016/0305653 | A1* | 10/2016 | Fields | F23D 14/82 |
| 2017/0319881 | A1* | 11/2017 | Barz | B01D 39/12 |
| 2018/0056100 | A1* | 3/2018 | Cockerham | A62C 4/02 |
| 2018/0056101 | A1* | 3/2018 | Cockerham | A62C 4/00 |
| 2018/0264300 | A1* | 9/2018 | Hong | A62C 4/02 |

FOREIGN PATENT DOCUMENTS

| | | | | |
|---|---|---|---|---|
| AU | 622847 | B | 4/1992 | |
| AU | 640138 | B | 8/1993 | |
| AU | 708185 | B2 | 1/1998 | |
| AU | 200038661 | B2 | 12/2000 | |
| AU | 2005325208 | A1 | 7/2006 | |
| AU | 2006279763 | A1 | 2/2007 | |
| AU | 2007237177 | A1 | 12/2007 | |
| CA | 2120121 | A1 | 11/1994 | |
| CA | 2282317 | A1 | 8/1998 | |
| CA | 2024083 | C | 6/2000 | |
| CA | 2361767 | A1 | 10/2000 | |
| CA | 2493557 | A1 | 1/2004 | |
| CA | 2526839 | A1 | 1/2005 | |
| CA | 2118089 | C | 5/2005 | |
| CA | 2601817 | A1 | 8/2007 | |
| CA | 2721526 | A1 | 7/2011 | |
| CA | 2844711 | A1 | 9/2015 | |
| CN | 2050125 | U | 12/1989 | |
| CN | 214875 | Y | 12/1993 | |
| CN | 101597563 | B | 5/2013 | |
| CN | 203075801 | U | 7/2013 | |
| CN | 104953165 | A | 9/2015 | |
| CN | 204793058 | U | 11/2015 | |
| CN | 105271709 | A | 1/2016 | |
| DE | 3701027 | A1 | 7/1988 | |
| DE | 102010016782 | A1 | 11/2011 | |
| DE | 102010016782 | A1 * | 11/2011 | A62C 4/00 |
| DE | 102013006738 | A1 * | 10/2014 | A62C 3/04 |
| DE | 102014007414 | A1 * | 11/2015 | A62C 4/00 |
| DE | 102016000848 | B3 * | 6/2017 | A62C 4/00 |
| EP | 2844046 | A2 | 3/2015 | |
| JP | 2006343104 | A | 12/2006 | |
| MX | 2008007988 | A | 6/2008 | |
| MX | 2012004595 | A | 5/2012 | |

OTHER PUBLICATIONS

"Machine Translation of DE 102016000848". 2019.*

Merriam Webster. https://www.merriam-webster.com/dictionary/transverse. 2019.*

"Machine Translation for DE102013006738A1". 2021.*

Extended European Search Report for EP Application No. 18197194.6, dated Feb. 14, 2019, 7 pages.

Communication Pursuant to Article 94(3) EPC for EP Application No. 18197194.6, dated Oct. 22, 2019, 4 pages.

* cited by examiner

FLAME ARRESTOR WITH FLUID DRAINAGE CAPABILITIES

BACKGROUND

Flame arrestors are commonly used in aerospace and other industries to prevent detonations and/or deflagrations from exiting an enclosure through a vent line or other opening to the external environment. The arresting components-mesh, corrugations, or other barriers-must remain permeable to gases and vapors to permit proper venting. In addition to requiring flame suppression, some aircraft systems, such as fuel and electronics systems, must also have drainage ports for condensation that can accumulate in contained spaces. Thus, the need exists for a flame arrestor that is permeable to both gases and liquids, while still meeting flame suppression requirements.

SUMMARY

A vented module includes a housing portion having a drainage side and a drainage port within the drainage side. The module further includes a flame arrestor including a first surface having a fluid inlet, a second surface having at least one fluid outlet, a labyrinth channel extending from the fluid inlet to the at least one fluid outlet, and at least one mesh screen disposed within the labyrinth channel. The flame arrestor is attached to the housing portion such that the drainage port is aligned with the fluid inlet.

A method of providing flame suppression for a vented module includes forming a flame arrestor having a fluid inlet and a fluid outlet, and extending a labyrinth channel between the fluid inlet and the fluid outlet. The method further includes aligning the fluid inlet with a drainage port of a housing, and attaching the flame arrestor to the housing.

DETAILED DESCRIPTION

The present invention is directed to a vented structure having a flame arrestor mounted thereto. The structure includes a housing having a drainage port, and the flame arrestor includes a fluid inlet that is aligned with the drainage port. A labyrinth-like channel within the flame arrestor extends from the fluid inlet to one or more fluid outlets. The flame arrestor also includes a mesh screen disposed within the labyrinth channel. The labyrinth channel and mesh are designed to allow condensation from within the larger structure to pass through the flame arrestor.

Figure 1:
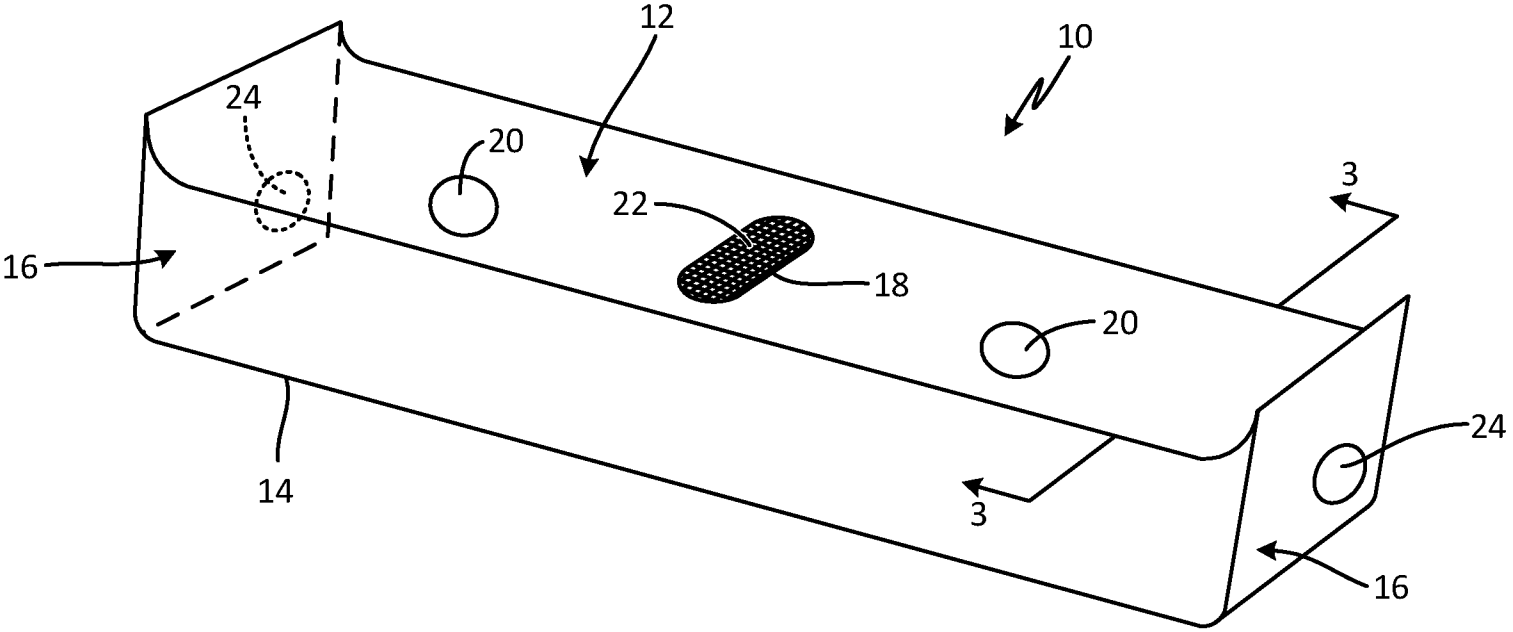
FIG. 1 is a perspective view of a flame arrestor.
Figure 2:
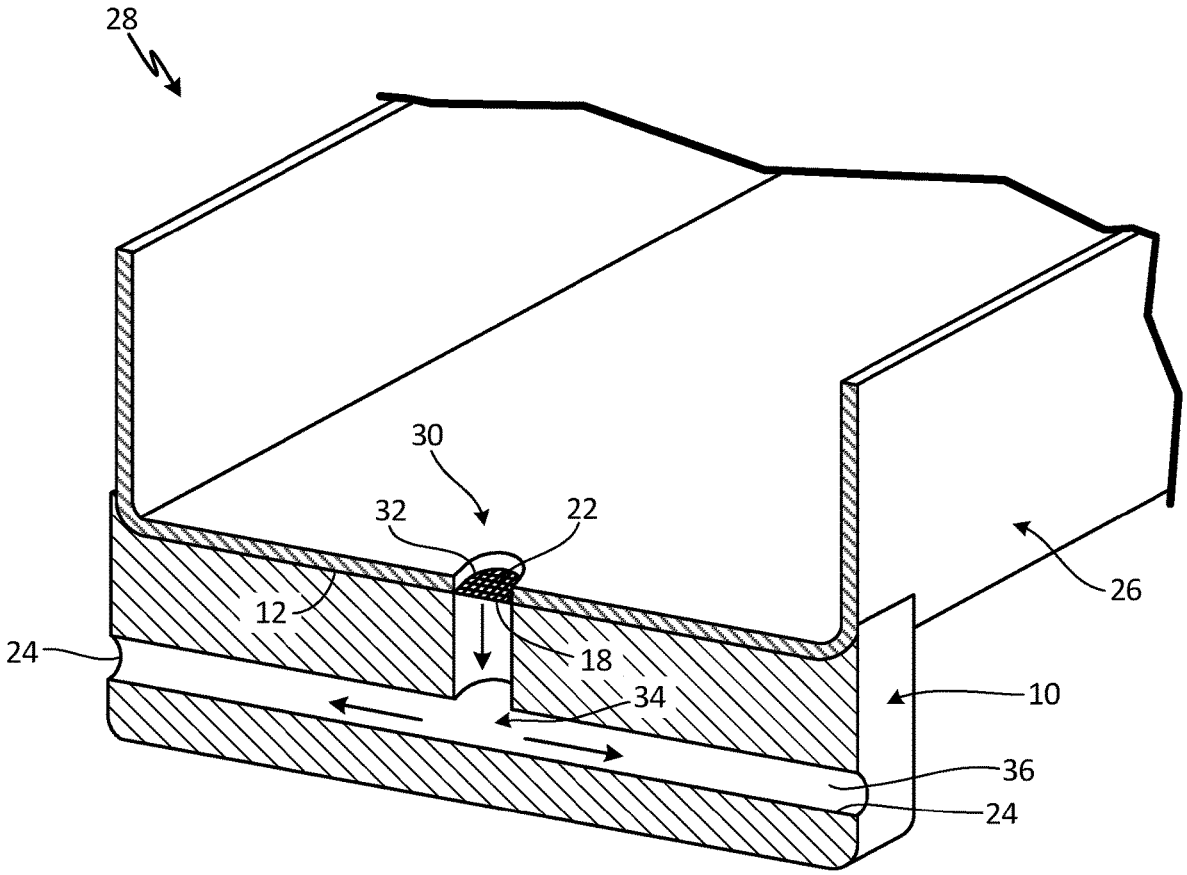
FIG. 2 is a perspective cross-section of a module including the flame arrestor of FIG. 1.

FIG. 1 is a perspective view of flame arrestor 10, configured for attachment to a housing (shown in FIG. 2). Flame arrestor 10 includes mating surface 12, bottom surface 14, and sides 16 generally orthogonal to both mating and bottom surfaces 12 and 14, respectively. Mating surface 12 includes fluid inlet 18 and openings 20, through which screws or other fasteners can be passed. Mesh screen 22 is attached to flame arrestor 10 at inlet 18. Flame arrestor 10 also includes fluid outlets 24, two of which are shown in FIG. 1 in opposing sides 16. In other embodiments, flame arrestor 10 can include just one, two, or more than two outlets 24 in any of the sides 16, or bottom surface 14.

FIG. 2 is a perspective cross-section showing flame arrestor 10 attached to housing 26 to form module 28. Housing 26 can belong to, for example, a differential pressure transducer, or any other system in which condensation or other fluids might collect and require draining. Housing 26 includes drainage port 32 extending through drainage side 30. When arrestor 10 is attached to housing 26, mating surface 12 abuts drainage side 30 of housing 26, such that fluid inlet 18 is aligned with drainage port 32. Arrestor 10 further includes channel 34 extending from inlet 18 to outlets 24. Channel 34 includes an inner surface 36 that is generally smooth.

In operation, condensation exits housing 26 via drainage port 32, enters arrestor 10 through inlet 18, and flows through channel 34 to an outlet 24, as is shown by the arrows. In the view shown in FIG. 2, channel 34 has a generally T-shaped cross-section, such that the fluid flow path requires a 90° turn to reach either outlet 24. Other cross-sectional shapes and flow path angles are contemplated herein. Although permeable to condensation and other fluids, the combination of mesh screen(s) 22 and the configuration of channel 34 helps inhibit flame propagation through module 28 by affecting the kinetics of combustion (e.g. temperature and pressure). Sources of a potential combustion within module 28 can include, for example, fuel vapors from nearby fuel lines, or other combustible fluids, depending on the location of module 28.

Figure 3:
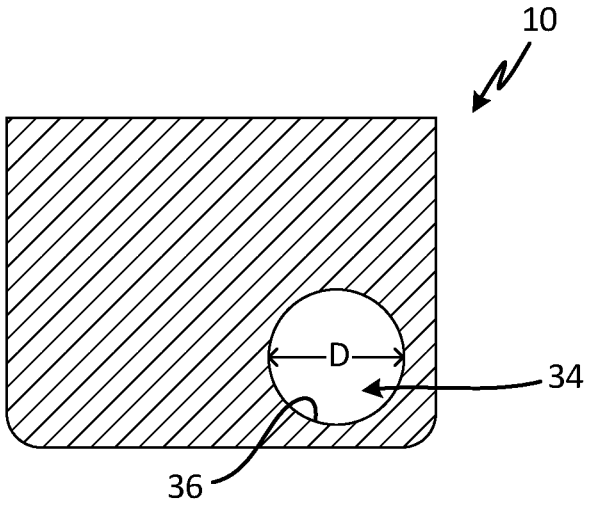
FIG. 3 is a cross-section of the flame arrestor of FIG. 1.

FIG. 3 is an enlarged cross-section of flame arrestor 10, taken along line 3 of FIG. 1. As can be seen in FIG. 3, channel 34 has a circular cross-section, and a diameter D. Other cross-sectional shapes of channel 34 are contemplated herein. Ideally, the ratio of the length to the diameter of channel 34 is at least 10:1.

Figure 4:
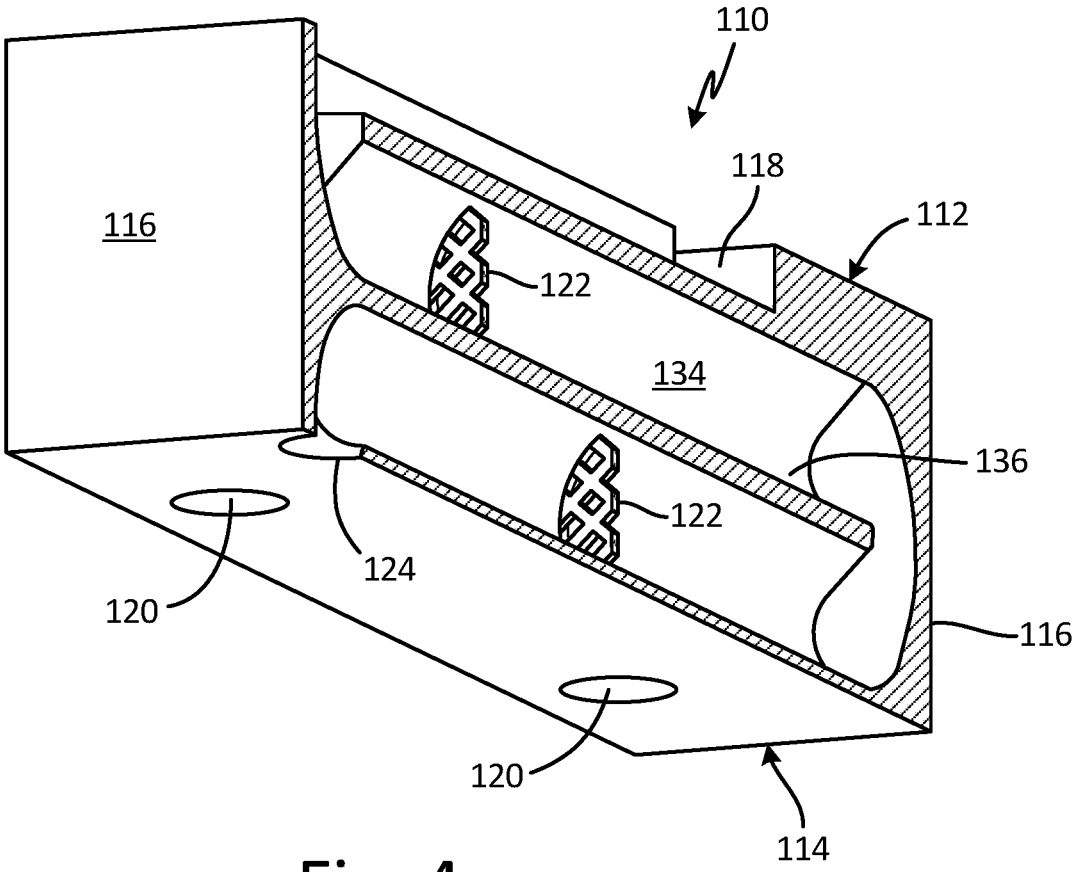
FIG. 4 is a perspective cross-section of a second alternative flame arrestor.

FIG. 4 is a perspective cross-section of alternative flame arrestor 110. In the embodiment shown, arrestor 110 includes mating surface 112, bottom surface 114, and sides 116 generally orthogonal to mating and bottom surfaces 112 and 114. Mating surface 112 includes fluid inlet 118 and bottom surface 114 includes openings 120. Unlike the configuration of arrestor 10, channel 134 has a serpentine shape and multiple mesh screens 122 disposed within it. Arrestor 110 can also include only a single mesh screen 122 at any location along channel 134 (including at inlet 118), or it can include more than two mesh screens 122, depending on the fluid drainage and flame suppression requirements. Also unlike arrestor 10, a single fluid outlet 124 is located within bottom surface 114. However, other embodiments of arrestor 110 can include one or more fluid outlets 124 in any of bottom surface 114 or sides 116.

Figure 5:
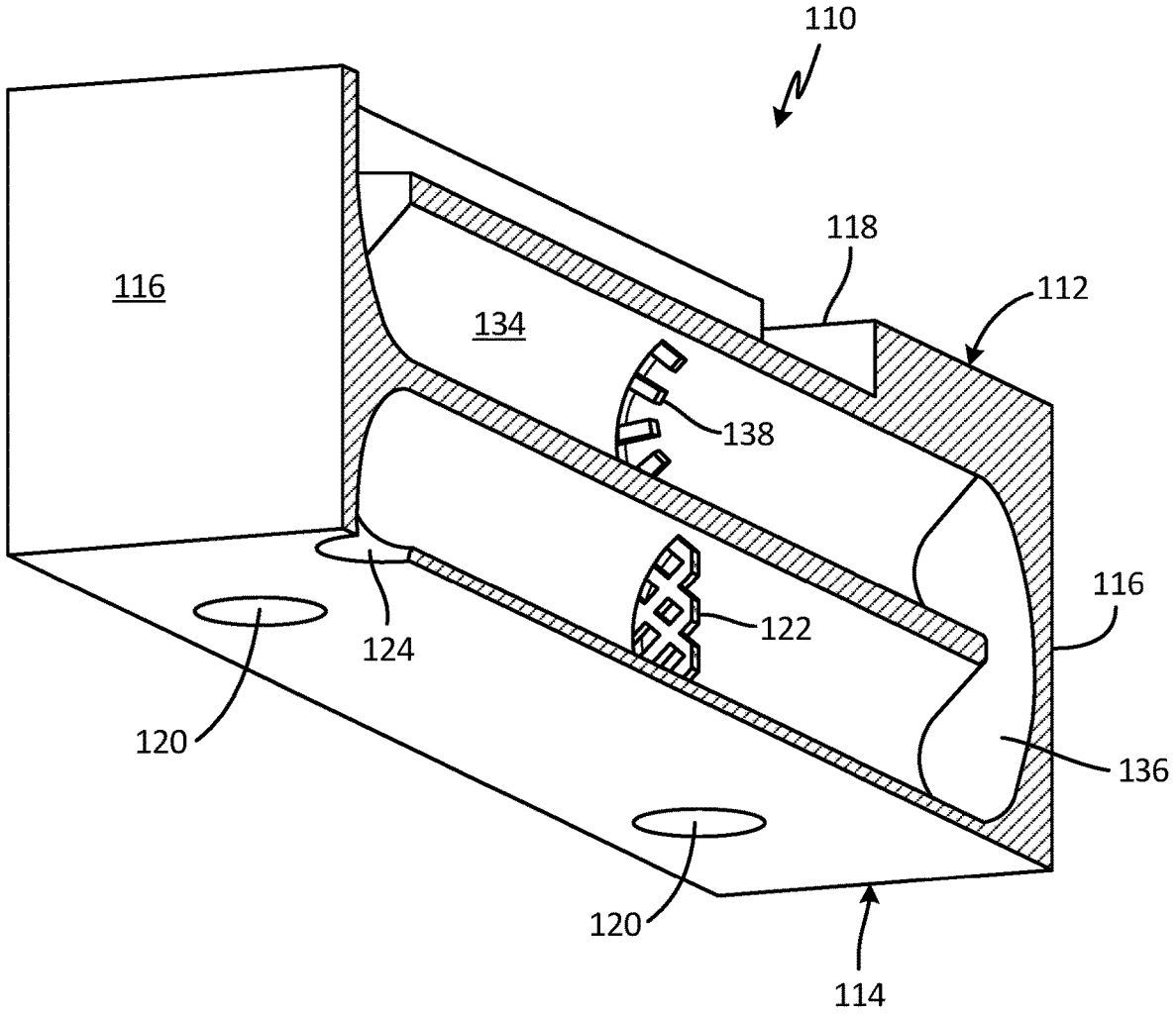
FIG. 5 is a perspective cross-section of a third alternative flame arrestor.

Channel 134 includes an inner surface 136, which can include smooth and/or roughened portions. For example, FIG. 5 is a perspective cross-section of flame arrestor 110 in which inner surface 136 of channel 134 includes ribs 138. Other types of disruptive surface features designed to inhibit flame propagation, such as dimples, are contemplated herein.

Like channel 34, channel 134 has a circular cross-sectional shape. Other cross-sectional shapes, such as an ellipse or quadrilateral, are contemplated herein. Channel 134 also has a length L and a diameter D (not labeled in FIGS. 4 and 5). The ratio of length to diameter is ideally 10:1 or greater, but can be less depending on the application.

Figure 6A:
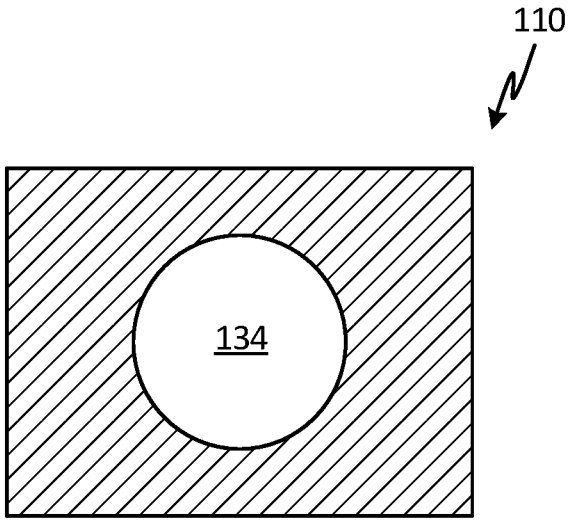
FIGS. 6A and 6B are cross-sections of a labyrinth channel near the fluid inlet and fluid outlet, respectively, of a fourth alternative flame arrestor.
Figure 6B:
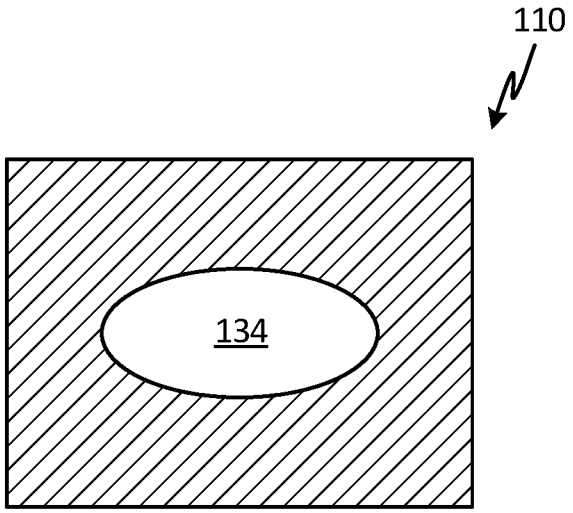

In certain embodiments, the cross-sectional shape and/or diameter of channel 134 can vary from inlet 118 to outlet 124. For example, in FIGS. 6A and 6B, an initially circular channel 134 (FIG. 6A) transitions to an elliptical channel 134 (FIG. 6B) in a region near outlet 124. Other combinations of varying shapes and/or diameters are contemplated herein.

The disclosed flame arrestors can be formed using either traditional or additive manufacturing techniques. For example, arrestor 10 can be formed using a machining process to create inlet 18, outlets 24, and channel 34. Mesh screen 22 can be press fit to inlet 18, or it can simply be sandwiched between arrestor 10 and housing 26. Arrestor 110 can be additively manufactured using a technique such as laser powder bed fusion, directed energy deposition, selective laser sintering, or other suitable additive technique. As such, mesh screens 122 and/or ribs 138 can be built directly into channel 134. Channel 134 can also have a more complex design, with various curves, cross-sectional shapes, and surface features that cannot typically be achieved using traditional subtractive manufacturing methods.

Flame arrestors 10, 110 can be formed from a metal, metal alloy, or other material suitable for flame suppression applications. Mesh screens 22, 122 can be formed from the same material as arrestors 10, 110, or a different metal/metal alloy. Mesh screens 22, 122 can also have a variety of aperture sizes, depending on the requirements of the specific arrestor. In embodiments including multiple mesh screens, aperture sizes can be uniform, or can vary from screen to screen.

Flame arrestors 10, 110 can further be attached to housing 26 using fasteners, or using a metal-joining process such as welding or brazing. Other attachment techniques providing a reasonably tight fit are contemplated herein. Arrestors 10, 110 can also be integrally formed with the housing or other structure for which it is providing flame suppression, such that the arrestor and housing are a monolithic structure.

The disclosed flame arrestors have many advantages. First, they can provide flame suppression while allowing proper fluid drainage within a given system. They can be individually tailored for attachment to a variety of housings or other structures. Additively manufactured embodiments specifically can include extensive combinations of features and enhancements. In addition to aerospace applications, the disclosed flame arrestors can be used in other transportation industries, as well as for chemical, refining, and power generation applications, to name a few, non-limiting examples.

Discussion of Possible Embodiments

The following are non-exclusive descriptions of possible embodiments of the present invention.

A vented module includes a housing portion having a drainage side and a drainage port within the drainage side. The module further includes a flame arrestor including a first surface having a fluid inlet, a second surface having at least one fluid outlet, a labyrinth channel extending from the fluid inlet to the fluid outlet, and at least one mesh screen disposed within the labyrinth channel. The flame arrestor is attached to the housing portion such that the drainage port is aligned with the fluid inlet.

The module of the preceding paragraph can optionally include, additionally and/or alternatively, any one or more of the following features, configurations and/or additional components:

The second surface is orthogonal to the first surface.

The second surface is parallel to the first surface.

The at least one fluid outlet includes a first fluid outlet and a second fluid outlet.

The first fluid outlet and the second fluid outlet are transverse.

The at least one mesh screen is disposed across the fluid inlet.

The at least one mesh screen comprises a first mesh screen and a second mesh screen.

The flame arrestor and the at least one mesh screen are formed from a metal or metal alloy.

The labyrinth channel includes an inner surface, and ribs on the inner surface.

The labyrinth channel has a length and a diameter, and the ratio of the length to the diameter is 10:1.

A cross-sectional shape of the labyrinth channel is generally circular.

A diameter or a cross-sectional shape of the labyrinth channel varies.

The labyrinth channel is T-shaped.

The labyrinth channel is serpentine-shaped.

The flame arrestor and the housing unit comprise a monolithic structure.

A method of providing flame suppression for a vented module includes forming a flame arrestor having a fluid inlet and a fluid outlet, and extending a labyrinth channel between the fluid inlet and the fluid outlet. The method further includes aligning the fluid inlet with a drainage port of a housing, and attaching the flame arrestor to the housing.

The method of the preceding paragraph can optionally include, additionally and/or alternatively, any one or more of the following features, configurations and/or additional components:

The method includes disposing a mesh screen within the labyrinth channel.

The method includes forming ribs on an inner surface of the labyrinth channel.

The method includes forming the flame arrestor using an additive manufacturing technique.

Attaching the flame arrestor to the housing includes a fastening, welding, or brazing technique.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A vented module comprising:

a housing portion having a drainage side and a drainage port within the drainage side; and a flame arrestor comprising:

a first surface having a fluid inlet;

a second surface having a fluid outlet;

a labyrinth channel formed from a metallic material and extending from the fluid inlet to the fluid outlet, the labyrinth channel comprising a plurality of elongate straight segments extending in a direction orthogonal to the fluid inlet, the labyrinth channel having a circular cross-sectional shape portion transitioning to an elliptical cross-sectional shape portion; and a first mesh screen formed from the metallic material and disposed within at least one of the plurality of elongate straight segments of the labyrinth channel at a location between and non-adjacent to the fluid inlet and the fluid outlet;

wherein the first mesh screen and the labyrinth channel together comprise a monolithic structure; and wherein the flame arrestor is attached to the housing portion such that the drainage port is aligned with the fluid inlet.

2. The module of claim 1, wherein the second surface is orthogonal to the first surface.

3. The module of claim 1, wherein the second surface is parallel to the first surface.

4. The module of claim 1, further comprising a third surface having a fluid outlet.

5. The module of claim 4, wherein the second surface and the third surface are parallel to one another and spaced apart by the first surface.

6. The module of claim 1 and further comprising: a second mesh screen disposed within the labyrinth channel and formed from the metallic material.

7. The module of claim 1, wherein the flame arrestor and the first mesh screen are formed from a metal or a metal alloy.

8. The module of claim 1, wherein the labyrinth channel comprises an inner surface, and wherein the inner surface includes ribs.

9. The module of claim 1, wherein the labyrinth channel comprises a length and the circular cross-sectional shape portion comprises a diameter, and wherein a ratio of the length to the diameter is 10:1.

10. The module of claim 1, wherein a diameter of the labyrinth channel varies.

11. The module of claim 1, wherein the labyrinth channel is serpentine-shaped.

12. A method of providing flame suppression for a vented module, the method comprising:

forming a flame arrestor having a fluid inlet and a fluid outlet using an additive manufacturing technique;

extending a labyrinth channel between the fluid inlet and the fluid outlet; the labyrinth channel being formed from a metallic material and comprising a plurality of elongate straight segments extending in a direction orthogonal to the fluid inlet, the labyrinth channel having a circular cross-sectional shape portion transitioning to an elliptical cross-sectional shape portion;

forming a first mesh screen from the metallic material and within a straight segment of the labyrinth channel at a location between and non-adjacent to the fluid inlet and the fluid outlet, such that the first mesh screen divides an upstream portion from a downstream portion of the labyrinth channel, and wherein the first mesh screen and labyrinth channel together comprise a monolithic structure;

aligning the fluid inlet with a drainage port of a housing; and attaching the flame arrestor to the housing.

13. The method of claim 12 and further comprising: forming ribs on an inner surface of the labyrinth channel.

14. The method of claim 12, wherein attaching the flame arrestor to the housing comprises a fastening, welding, or brazing technique.

* * * * *